United States Patent [19]

Le Devehat

[11] 4,252,162

[45] Feb. 24, 1981

[54] ARTICULATED LOADING ARM ATTITUDE CONTROL SYSTEM

[75] Inventor: Eugene Le Devehat, Saligny, France

[73] Assignee: FMC Corporation, San Jose, Calif.

[21] Appl. No.: 26,106

[22] Filed: Apr. 2, 1979

[30] Foreign Application Priority Data

Apr. 20, 1978 [FR] France ..... 78 11778

[51] Int. Cl.[3] ..... B65B 3/04

[52] U.S. Cl. ..... 141/387; 137/615

[58] Field of Search ..... 9/8 P, 8 R, 15; 61/46, 61/46.5; 114/0.5 R; 137/236, 335.16, 615; 141/279, 387, 388

[56] References Cited

U.S. PATENT DOCUMENTS 3,889,728 6/1975 Riche ..... 137/615

*Primary Examiner*—Houston S. Bell, Jr.

*Attorney, Agent, or Firm*—L. B. Guernsey; W. W. Ritt, Jr.

[57] ABSTRACT

Fluid transferring apparatus, more commonly referred to as a marine loading arm, comprising rigid, pivotally-interconnected inboard and outboard arm members pivotally mounted on an upstanding riser, and a system for maintaining the outboard member in a substantially horizontal attitude during the fluid transfer process. A first hydraulic ram, connected between the riser and the inboard member, and a second hydraulic ram, connected between the inboard member and the outboard member, are functionally coupled to a hydraulic system with an outboard arm member attitude sensing means, so that if the outboard arm member pivots more than a pre-selected distance above a horizontal attitude the first hydraulic ram provides pressurized fluid to the second hydraulic ram to return the outboard member to its horizontal attitude.

11 Claims, 6 Drawing Figures

ARTICULATED LOADING ARM ATTITUDE CONTROL SYSTEM

BACKGROUND OF THE INVENTION

1. Field of the Invention

The present invention relates to fluid handling apparatus, and more particularly to marine tanker loading arms with systems for controlling the movements of the arm sections.

2. Description of the Prior Art

Various types of fluid transferring devices are used in conveying fluids between a dock, buoy, or floating barge and tanker or other marine transport vessel. Some of these devices are large articulated pipe structures referred to as marine loading arms, such an arm generally comprising an upstanding riser on which are mounted two or more arm members that are pivotally interconnected by swivel joints in a manner to allow the arm to accommodate itself to movements of the buoy, barge and/or tanker while fluid transfer is in progress. Some examples of these prior art fluid transferring devices are disclosed in the U.S. Pat. Nos. 2,980,150 and 3,382,892 to Bily, 3,581,769 to Haley, and 3,889,728 to Riche.

It is common practice to install weights to counterbalance a loading arm about the horizontal pivot axis at the riser so that it may be more easily maneuvered. To achieve a constant balanced condition, in some marine loading arms the weight of the counterbalance is varied by adding or subtracting water or other fluid from a container positioned on the counterbalance or its support. Since the weight per unit volume of the liquid is relatively low, this type of counterbalance system has the disadvantage of requiring a large container for the liquid, and also a pumping system to move the liquid into the container. Other counterbalancing systems employ movable counterweights that can be repositioned on their supports to compensate for changes in the weight of the arm members that occur as these members are filled with or emptied of fluid during start up and termination of the fluid transfer operation. One difficulty with this latter type of system is that it is not sufficiently responsive to constantly maintain the arm in a balanced condition during these changes in weight.

Another difficulty with some of the prior art counterbalancing systems is that the counterweights are positioned at a considerable distance above the deck of the ship or the dock on which the loading arm is mounted. This causes the center of gravity to be relatively high, thereby producing undue stress on the riser which supports both the arm members and the counterweights. Counterweights also present a safety hazard to people who may be working beneath them, for these weights usually weigh several thousand pounds. Thus, it is desirable that all counterweights be mounted as near as possible to the level of the deck or dock. However, a counterweight mounted near the deck or dock may pivot downward beyond its normally lowest position and damage or interfere with valves, pressure gauges, piping, and other objects mounted on the dock, when the outboard end of the arms is allowed to rise above the highest level for which it was designed. This problem can occur during normal manipulations of the arm as well as when the arm is quickly disconnected from the tanker manifold, such as when an emergency situation develops.

SUMMARY OF THE INVENTION

The present invention overcomes the foregoing problems by providing a fluid loading arm comprising a rigid inboard member mounted on an upstanding riser for pivotal movement about a first horizontal axis, a rigid outboard member pivotally connected at one of its ends to the outer end of the inboard member for pivotal movement about a second horizontal axis, a first power means, such as a hydraulic ram, for controlling and pivoting the inboard member about the first horizontal axis, means connected between the inboard and outboard members for changing the attitude of the outboard member with respect to the inboard member independently of movement of the inboard member, a second power means for controlling and operating the inboard-outboard connection means, and a control circuit interconnecting the first and second power means with a level or attitude sensing means that senses the attitude of the outboard member and, if the outboard member pivots more than a pre-selected amount above a horizontal attitude, actuates the power means to adjust the attitude of the inboard member sufficiently to return the outboard member to the acceptable horizontal attitude, thereby preventing counterweight means for the arm from colliding with objects mounted beneath it on the dock. The level or attitude sensing means comprises at least one pendulum that responds to pivotal movement of the outboard member about a horizontal axis, and this sensing means is coupled to valve means in a hydraulic or other fluid circuit that provides operating pressure to the power means when the valve means is opened in response to a signal from the pendulum. The fluid circuit interconnects the first and second power means with valve means so that the power means are actuated to change the attitude of the arm members only when the outboard member pivots into a preselected attitude above the horizontal.

DESCRIPTION OF THE PREFERRED EMBODIMENT

Figure 1:
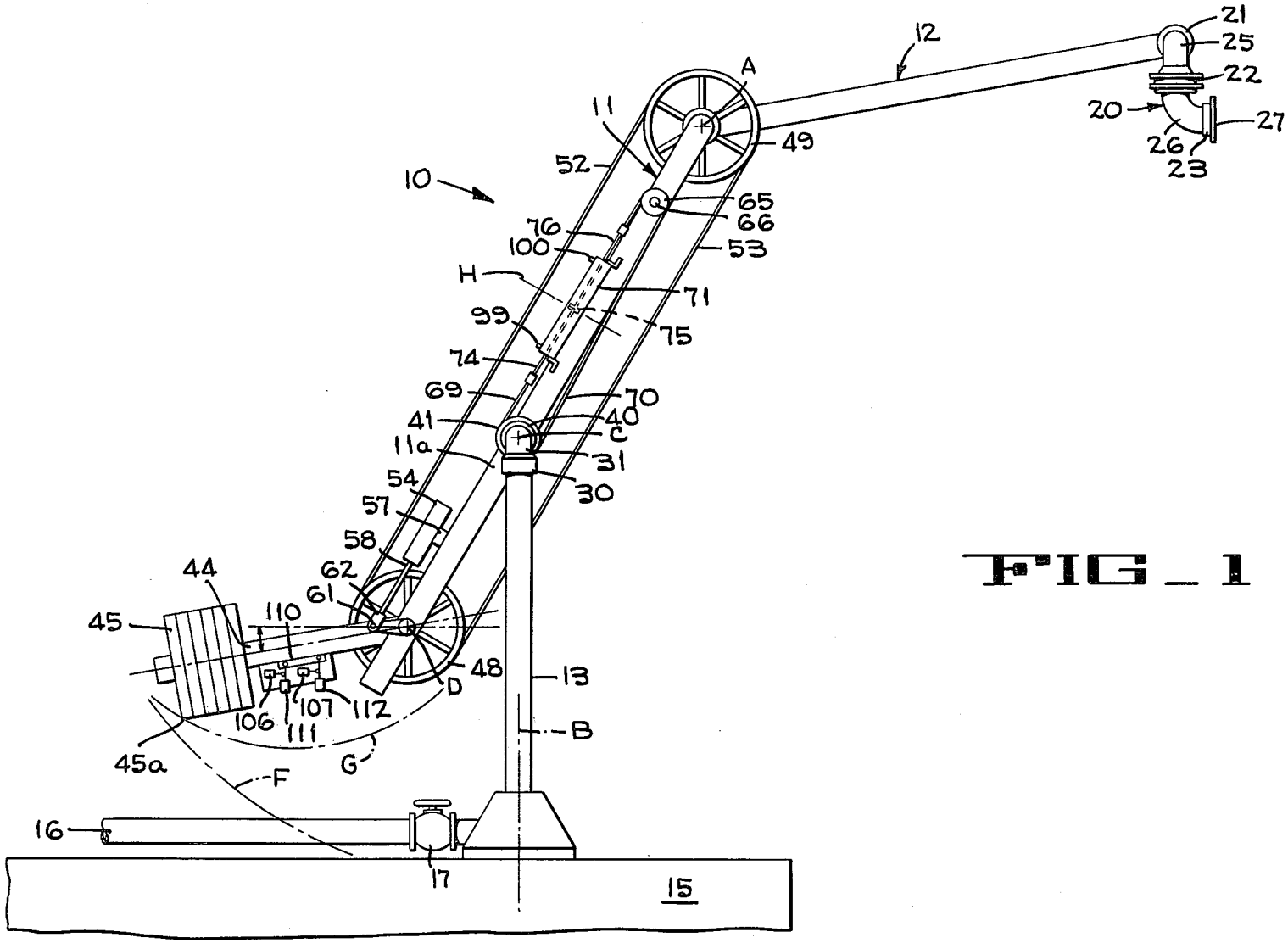
FIG. 1 is a diagrammatic side elevation of a fluid loading arm according to the present invention, the arm mounted on a dock and with the outboard member at a nearly horizontal attitude.

A fluid loading arm 10 in accordance with the present invention comprises inboard and outboard arm members 11 and 12, respectively, these members being pivotally interconnected in substantially end-to-end relationship for relative movement about a horizontal axis A. The inboard member 11 is pivotally mounted on an upstanding riser 13 for universal movement about intersecting vertical and horizontal axes B and C, respectively, and the riser 13 is shown mounted on a dock or other supporting structure 15. The riser 13 is connected to a pipeline or other conduit 16 that extends to a fluid storage facility (not shown) for supplying fluid to, or conducting it from, the loading arm 10 during a loading or unloading operation. A valve 17, positioned between the pipeline 16 and the riser 13, provides control of the fluid flowing through the pipeline 16.

The outboard member 12 carries at its outer end a triple swivel joint assembly 20 (FIG. 1) comprising first, second and third swivel joints 21, 22 and 23 interconnected by first and second 90-degree pipe elbows 25 and 26, respectively. The outer end of the swivel joint assembly 20 includes a flange 27 which can be brought into alignment with and connected to a flange of a tanker manifold (not shown) to facilitate transfer of fluid from the loading arm to the tanker. The swivel joint assembly 20 enables the loading arm to follow the movements of the marine vessel to which it is coupled so that fluid transfer can be safely and efficiently accomplished.

Figure 2:
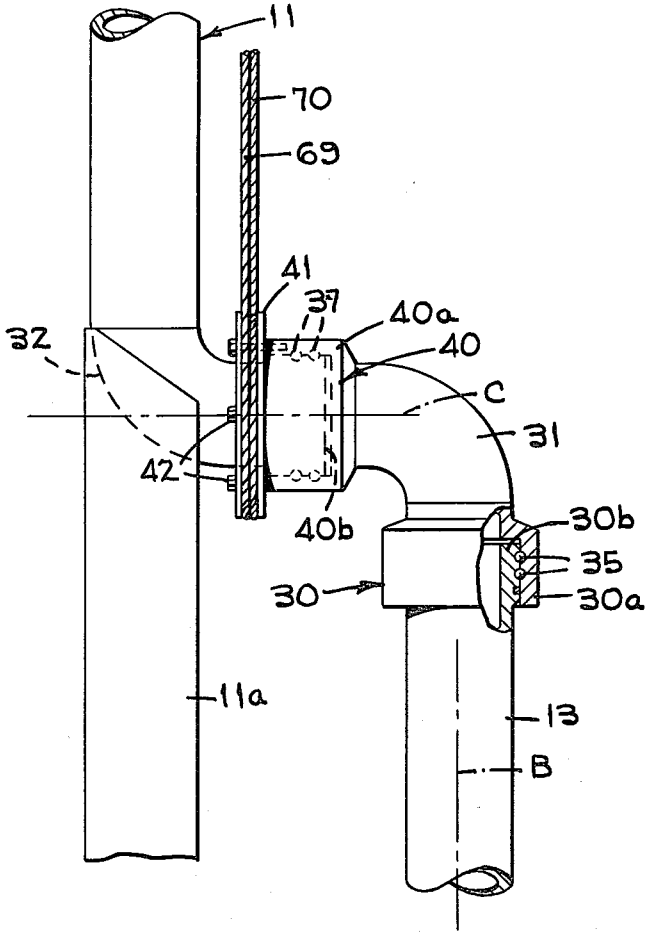
FIG. 2 is an enlarged fragmentary elevation of the loading arm of FIG. 1, showing details of a means for mounting the inboard arm section on the riser.

The inboard arm member 11 is mounted on the riser 13 for pivotal movement about the vertical axis B and the horizontal axis C (FIG. 2) by pipe swivel joints 30, 40, respectively, and 90-degree pipe elbows 31, 32. The lower end of the elbow 31 is fixed to the outer or female element 30*a* of the swivel joint 30, the upper end of the riser 13 is fixed to the inner or male element 30*b* of the joint 30, and the elements 30*a*, 30*b* are rotatably interconnected by bearing balls 35. The other or upper end of the pipe elbow 31 is fixed to the outer or female element 40*a* of the swivel joint 40, the inner end of the inboard arm member's elbow 32 is fixed to the inner or male element 40*b* of the joint 40, and the elements 40*a*, 40*b* are rotatably interconnected by bearing balls 37. Welded or otherwise fixed to the elbow 32 and the inner end of the inboard arm member 11 is an arm extension 11*a* on which is mounted a counterweight beam 44 with a counterweight 45, this mounting providing for pivotal movement of the beam and counterweight about a horizontal axis D.

As illustrated in FIG. 1, the loading arm 10 further includes a first pantograph assembly comprising an inboard sheave 48 and an outboard sheave 49, cables 52 and 53, and a hydraulic ram 54. The sheave 48 is pivotally mounted on the inboard arm extension 11*a*, and is fixed to, and thus pivots with, the counterweight beam 44 about the axis D. The sheave 49 is mounted on and fixed to the outboard arm member 12 coaxial with, and thus pivotable with and about, the axis A. The cables 52 and 53 are trained around the sheaves 48, 49, and their inner ends are secured to these sheaves so that rotation of either sheave causes like rotation of the other sheave in the conventional and well-known manner. The cylinder of the hydraulic ram 54 is attached to the arm extension 11*a* by a bracket 57, and the ram's piston rod 58 is attached to the counterweight beam 44 by a pin 61 and clevis 62.

Thus, when the piston rod 58 is retracted into the cylinder 54, the inboard sheave 48 and the counterweight beam 44 are rotated clockwise (as viewed in FIG. 1) about the horizontal axis D, causing the outboard sheave 49 and the outboard arm member 12 to rotate clockwise about the horizontal axis A, thereby lowering the outer end of the outboard member 12. Accordingly, when the piston rod 58 is extended from the cylinder 54, the inboard sheave 48, the counterweight beam 44, the outboard sheave 49, and the outboard arm member 12 pivot counterclockwise about their respective axes, thus elevating the outer end of the outboard arm member 12.

The inboard arm member 11 is pivoted relative to the riser about the horizontal axis C (FIGS. 1–4) by means of a second pantograph assembly comprising sheaves 41 and 65, a pair of cables 69 and 70, and a hydraulic ram 71. The sheave 41 is fixed to the female element 40*a* of the swivel joint 40 by bolts 42 or other suitable means, and thus it is coaxial with but does not rotate around the axis C. The sheave 65 is rotatably mounted on a shaft 66 that is fixed to the inboard arm member 11. One end of the cable 69 is trained around and secured to the sheave 41, and the other end of the cable 69 is secured to a piston rod 74 which is connected to a piston 75 inside the cylinder of the ram 71. In similar manner, one end of the cable 70 is trained around and secured to the sheave 65, and the other end of the cable 70 is connected to a piston rod 76 which is also connected to the piston 75.

Power to operate the hydraulic rams 54, 71 is provided by a pressurized hydraulic fluid source 80 (FIGS. 5 and 6) that includes a pump, fluid reservoir, and associated control valves (not shown) of a suitable type well known in the industry. The pressure source 80 is connected through hydraulic lines 83, 84, 85 and 86 to a selector valve 90 that functions to interconnect the source 80 with (FIG. 5) or isolate it from (FIG. 6) the loading arm hydraulic control system.

Figure 4:
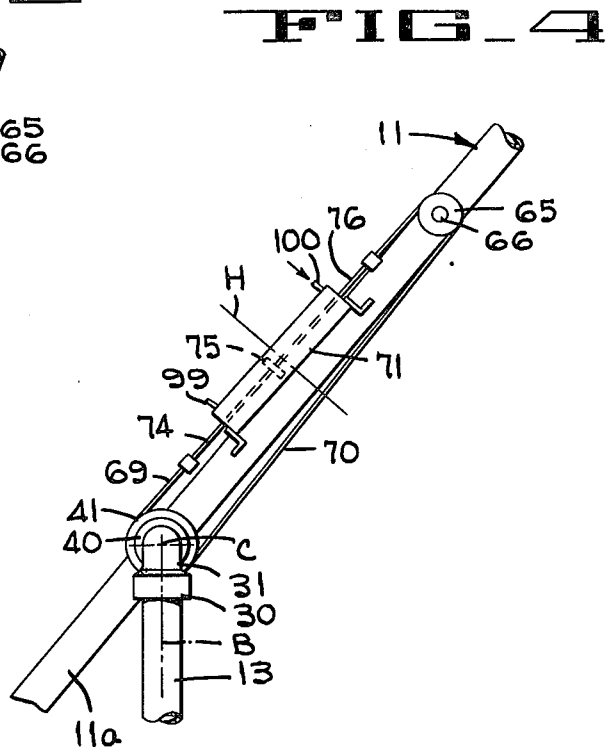
FIGS. 3 and 4 are fragmentary views of the loading arm of FIG. 1, illustrating operation of the power means for raising and lowering the inboard member.
Figure 3:
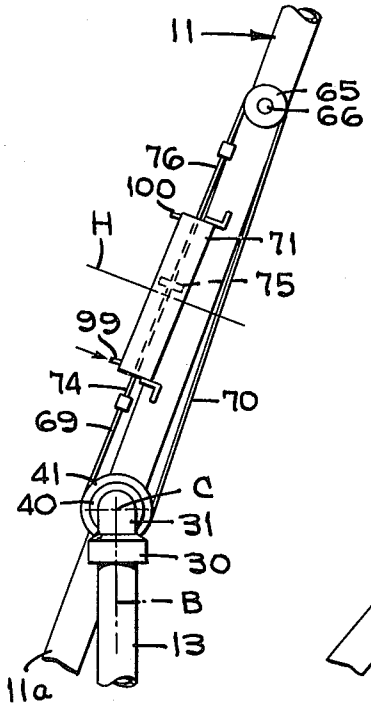

Controlled pivotal movement of the inboard member 11 about the horizontal axis C is illustrated in FIGS. 1, 3 and 4, with the inboard member shown in a "mid-position" in FIG. 1 wherein the piston 75 is at its position H. Conducting fluid under pressure through an inlet/outlet 99 to the lower portion 71*b* of the ram 71 while venting fluid from the upper portion 71*a* through an inlet/outlet 100 causes the piston 75 to move towards the position shown in FIG. 3, thus also causing the inboard member 11 to pivot counterclockwise from the mid-position toward its position shown in FIG. 3. In a similar manner, conducting fluid under pressure through the inlet/outlet 100 to the upper portion 71*a* of the ram 71 while venting fluid from the lower portion 71*b* through the inlet/outlet 99 causes the ram piston 75 to move toward the position shown in FIG. 4, thus also causing the inboard member 11 to pivot clockwise toward the position shown in FIG. 4.

Figure 5:
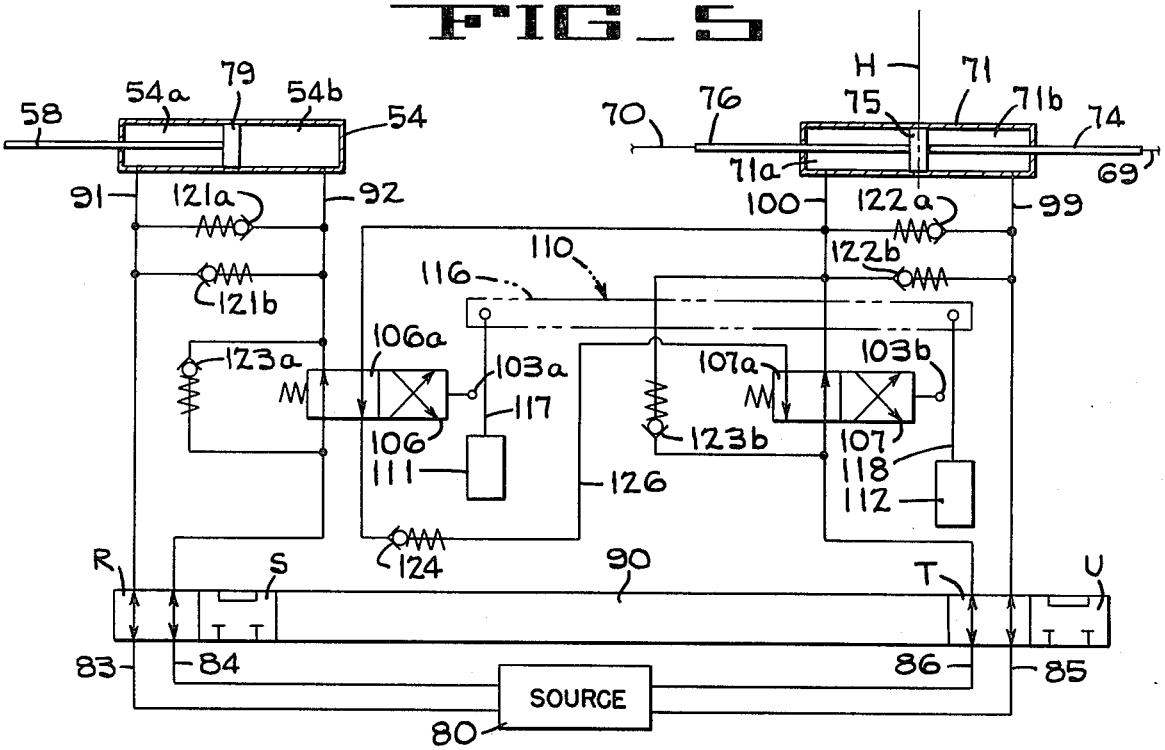
FIG. 5 is a schematic of a hydraulic circuit for controlling the attitude of the inboard and outboard arm members of the loading arm of FIGS. 1–4, showing the circuit elements in position for direct individual control of pivotal movement of the inboard and outboard arm members.

Direct individual control of the attitude of the inboard arm member 11 and the outboard arm member 12 is provided when the selector valve 90 is open, that is in the "direct control" position, as shown in FIG. 5. In this position the R-section of the selector valve 90 interconnects the hydraulic lines 83 and 84 to the inlets/outlets 91 and 92, respectively, of the outboard hydraulic ram 54, so that by operation of the appropriate valve or valves (not shown) in the source 80 to pressurize, or vent, the inlet/outlet 91, and vent, or pressurize, the inlet/outlet 92 the outboard arm member 12 will be lowered, or raised, respectively, about the axis A. Likewise, when the valve 90, is open the T-section thereof interconnects the hydraulic source lines 85 and 86 to the inlets/outlets 99 and 100, respectively, of the inboard hydraulic ram 71, so that by operating the appropriate source valve or valves (not shown) these inlets/outlets can be selectively pressurized or vented to raise or lower the inboard arm member 11 about the axis C. As will be fully described later, the illustrated embodiment of an attitude control system of this invention includes a pair of pendulums 111, 112 (FIGS. 5 and 6) and a pair of spool valves 106, 107, and when the rams 54, 71 are controlled directly the pendulums 111, 112 must be locked in a direct-control position to prevent them from contacting a pair of shift knobs 103*a*, 103*b* on the spool valves 106, 107. This may be done by any one of several means (not shown).

The level or attitude control system of this invention includes a level or attitude sensing means (FIGS. 1, 5 and 6) attached to the balancing beam 44 (FIG. 1) to sense the attitude of the outboard arm member 12 and actuate the rams 54, 71 to cause the outboard member to pivot toward the horizontal when this member deviates therefrom by a predetermined amount. The sensing means 110 thereby prevents the counterweight 45 from colliding with apparatus and personnel in the normal path of its downward movement when the inboard arms is rotated in a counterclockwise direction. If the inboard arm member 11 were pivoted in a counterclockwise direction about the horizontal axis C, and if the outboard arm member 12 were allowed to move along with the inboard member, the lower end 45*a* of the counterweight 45 would follow the arc F (FIG. 1) thereby possibly colliding with the pipeline 16, the valve 17 and/or personnel in that area. However, if the outboard arm member 12 is retained in a substantially horizontal position as the inboard arm member 11 pivots in a counterclockwise direction, the lower end 45*a* of the counterweight 45 follows the arc G (FIG. 1), which arc is safely above the pipeline 16 and other objects located on the dock 15.

The attitude sensing means 110 (FIGS. 1, 5 and 6) includes a pair of small pendulums 111, 112 pivotally suspended from the ends of a support bar 116 by a pair of support rods 117, 118, respectively, and a pair of hydraulic spool valves 106, 107 each having a shift knob 103*a*, 103*b*. The support bar 116 is mounted on and parallel to the counterweight beam 44, and the shift knobs 103*a*, 103*b* are each positioned adjacent one of the support rods 117, 118 when the support bar 116 is in a substantially horizontal position, as it would be when the beam 44 and the outboard arm member 12 are in a substantially horizontal position. As will be fully described later, the valves 90, 106 and 107 function to conduct fluid pressure between hydraulic rams 54 and 71 to automatically maintain the outboard arm member 12 in a substantially horizontal position as the inboard member 11 is elevated or depressed due to movement of a marine tanker to which the arm is connected.

The attitude control system of the present invention further includes a pair of spring-loaded check valves 121*a*, 121*b* (FIGS. 5 and 6) to limit the hydraulic pressure between the ends of the hydraulic ram 54, a pair of spring-loaded check valves 122*a*, 122*b* to limit the hydraulic pressure between the ends of the hydraulic ram 71, a pair of spring-loaded check valves 123*a*, 123*b* to limit the pressure across the spool valves 106, 107, respectively, and a check valve 124 to limit pressure flow to one direction in a line 126.

Figure 6:
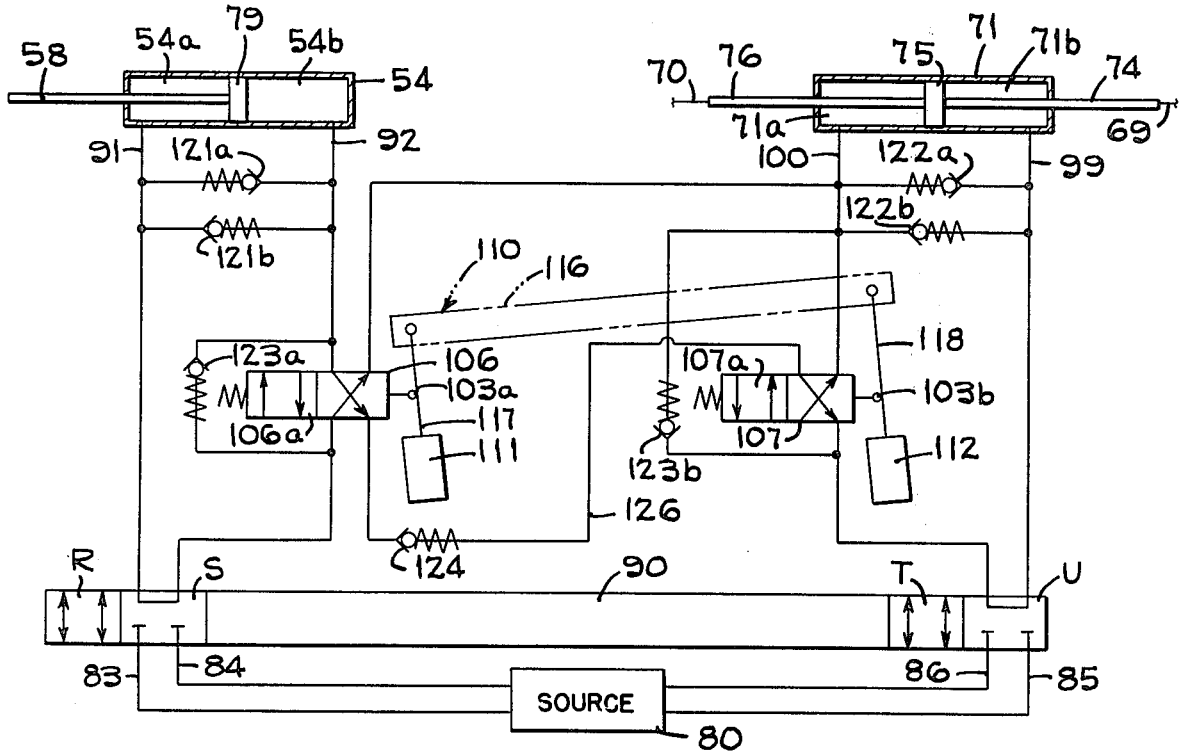
FIG. 6 shows the circuit elements of FIG. 5 in position to maintain the outboard arm member in a substantially horizontal attitude.

When the selector valve 90 is in the closed or "floating" position shown in FIG. 6, and the spool valves 106, 107 are in the open position shown in FIG. 5, the inboard and outboard arm members 11, 12 are free to change attitudes to follow the vertical and horizontal movements of a tanker (not shown) to which the arm 10 is connected as long as the outboard arm member 12 is within a predetermined number of degrees from the horizontal. Hydraulic fluid can move freely between the chambers 54*a* and 54*b* (FIG. 5) of the hydraulic ram 54 through line 91, section S of the selector valve 90, section 106*a* of the spool valve 106 and line 92, to allow free movement of the piston 79 and of the outboard conduit member 12. Hydraulic fluid also can move freely between the chambers 71*a* and 71*b* of the hydraulic ram 71 through line 99, section U of the selector valve 90, section 107*a* of the spool valve 107, and line 100 to allow free movement of the piston 75 within the ram 71, and thus of the inboard conduit member 11.

When the outboard conduit member 12 rotates counterclockwise to a predetermined position, such as 10 degrees above the horizontal, the counterweight beam 44 (FIG. 1) and the support bar 116 (FIGS. 1, 5 and 6) tilt far enough to cause the support rods 117, 118 to press against the shift knobs 103*a*, 103*b* and to shift the spool valves 106, 107 into the positions shown in FIG. 6. With the selector valve 90 in the floating position (FIG. 6) the chamber 71*a* of hydraulic ram 71 communicates through the valve 106 and the section S of the valve 90 to the chamber 54*a* of the hydraulic ram 54, and the chamber 71*b* is in communication with the chamber 54*b* of the ram 54 through the section U of the valve 90, the spool valves 107, 106, and check valve 124. When the valves are in this position, an upward or counterclockwise movement of the inboard conduit member 11 causes the piston 75 of the ram 71 to force fluid from the upper chamber 71*a* through spool valve 106 and selector valve 90 to the chamber 54*a* of the ram 54. The fluid flowing into the chamber 54*a* forces the piston 79 further into the cylinder of the ram 54, thereby forcing fluid from the chamber 54*b* and through valves 106, 124, 107 and 80 (section U) into the chamber 71*b*. This fluid flow causes the sheaves 48 and 49 (FIG. 1) to rotate clockwise and lower the outboard arm member 12 back toward the horizontal.

The clockwise rotation of the sheave 48 also causes the counterweight beam 44 and the counterweight 45 to pivot in a clockwise direction about the horizontal axis D, thus preventing the counterweight from colliding with equipment and/or people on the dock as the inboard conduit member 11 is pivoted counterclockwise about axis C.

The hydraulic ram 71 is larger in size than the hydraulic ram 54 to supply sufficient hydraulic fluid from the ram 71 to the ram 54 to insure that the outboard arm member 12 will pivot in a clockwise direction about the axis A at least as fast as the inboard arm member pivots in a counterclockwise direction about the axis C, thereby keeping the outboard arm within 10 degrees of the horizontal.

Although the best mode contemplated for carrying out the present invention has been herein shown and described, it will be apparent that modification and variation may be made without departing from what is regarded to be the subject matter of the invention.

What is claimed is:

1. An articulated loading arm for transferring fluid from one fluid handling means to another and for maintaining the outboard arm member of said loading arm in a substantially horizontal attitude during fluid transfer, said arm comprising:

a rigid inner arm member;

means mounting said inner arm member for pivotal movement about a first horizontal axis;

a rigid outer arm member pivotally connected at one of its ends to the outer end of said inner arm member for movement about a second horizontal axis;

a drive mechanism connected between said mounting means and said inner arm member for changing the attitude of said inner arm member with respect to said first horizontal axis;

a drive means connected between said outer arm member and said inner arm member for changing the attitude of said outer member with respect to said inner member;

attitude sensing means connected to said outer arm member for sensing the orientation of said outer member relative to the horizontal; and means for energizing said drive means when said sensing means determines that said outer arm member has tilted away from the horizontal a predetermined amount, said energized drive means causing said outer member to pivot toward the horizontal.

2. An articulated loading arm as defined in claim 1 wherein said energizing means includes means for coupling said drive means to said drive mechanism, said drive mechanism supplying energy to said drive means to pivot said outer arm member toward the horizontal when said inner arm member pivots away from the horizontal.

3. An articulated loading arm as defined in claim 1 wherein said attitude sensing means includes pendulum means coupled to said outer arm member, and valve means for interconnecting said drive mechanism and said drive means when said pendulum means senses that said outer arm member pivots a predetermined number of degrees away from the horizontal, said pendulum means controlling the opening of said valve means.

4. An articulated loading arm as defined in claim 1 wherein said drive mechanism and said drive means each includes hydraulic power means and a source of hydraulic power for energizing said power means.

5. An articulated loading arm for transferring fluid from one fluid handling means to another and for maintaining the outboard member of said loading arm in a substantially horizontal position during fluid transfer, said arm comprising:

a rigid inner arm member;

means mounting said inner arm member for pivotal movement about a first horizontal axis;

a rigid outer arm member pivotally connected at one of its ends to the outer end of said inner arm member for movement about a second horizontal axis;

a first hydraulic ram connected between said mounting means and said inner arm member for changing the attitude of said inner arm member with respect to said first horizontal axis;

a second hydraulic ram connected between said outer arm member and said inner arm member for changing the attitude of said outer member with respect to said inner member;

level sensing means connected to said outer arm member for sensing the orientation of said outer member relative to the horizontal; and means for coupling said first hydraulic ram to said second hydraulic ram when said level sensing means determines that said outer arm has pivoted away from the horizontal by a predetermined amount, said first hydraulic ram providing a corrective signal to said second hydraulic ram to pivot said outer member toward the horizontal when said inner arm member pivots away from the horizontal.

6. An articulated loading arm as defined in claim 5 including a source of hydraulic power, and means for selectively connecting said source of hydraulic power to said first and said second hydraulic rams to provide direct control of the attitudes of said inner and outer arm members.

7. An articulated loading arm as defined in claim 5 wherein said means for coupling includes valve means mounted between said first and said second hydraulic rams, and means for connecting said valve means to said level sensing means to interconnect said first and said second hydraulic rams when said outer arm member pivots away from the horizontal by said predetermined amount.

8. An articulated loading arm for transferring fluid from one fluid handling means to another and for maintaining the outboard portion of said loading arm in a substantially horizontal position during fluid transfer, said arm comprising:

a rigid inner conduit member;

means mounting said inner conduit member for pivotal movement about a first horizontal axis;

a rigid outer conduit member pivotally connected at one of its ends to the outer end of said inner conduit member for movement about a second horizontal axis;

a first hydraulic ram connected between said mounting means and said inner conduit member for changing the attitude of said inner conduit member with respect to said first horizontal axis;

a second hydraulic ram connected between said outer conduit member and said inner conduit member for changing the attitude of said outer conduit member with respect to said inner conduit member;

a source of pressurized hydraulic fluid;

means for selectively connecting said fluid source to said first and said second hydraulic rams to control the attitude of said inner and said outer conduit members;

level sensing means connected to said outer conduit member for sensing the attitude of said outer conduit member relative to a horizontal plane; and valve means for selectively connecting said second hydraulic ram to said first hydraulic ram, said valve means being coupled to said level sensing means causing said valve means to interconnect said first and said second hydraulic rams when outer conduit member pivots away from said horizontal plane by a predetermined amount.

9. An articulated loading arm as defined in claim 8 wherein said first hydraulic ram provides pressurized fluid to said second hydraulic ram while said hydraulic rams are interconnected to pivot said outer conduit member toward said horizontal plane in response to a pivotal movement of said inner conduit member.

10. An articulated loading arm as defined in claim 8 wherein said level sensing means includes pendulum means coupled to said outer conduit member, said pendulum means being mounted adjacent said valve means, said pendulum means controlling the opening of said valve means in response to a tilting of said outer conduit member.

11. An articulated loading arm as defined in claim 8 including a counterweight, means for pivotally mounted said counterweight to the inboard end of said inner conduit member, and means for coupling said counterweight to said outer conduit member to pivotally interconnect said counterweight and said outer conduit member.

* * * * *